US005555740A

United States Patent [19]

Stevenson

[11] Patent Number: 5,555,740

[45] Date of Patent: Sep. 17, 1996

[54] MANUAL REFRIGERATION APPARATUS

[76] Inventor: Robert L. Stevenson, 1624 Cessford St., Lake Charles, La. 70601

[21] Appl. No.: 501,610

[22] Filed: Jul. 12, 1995

[51] Int. Cl.[6] ..... F25D 3/08

[52] U.S. Cl. ..... 62/293; 62/457.9; 62/498; 417/234

[58] Field of Search ..... 62/293, 457.9, 62/498, 115; 417/234

[56] References Cited

U.S. PATENT DOCUMENTS

| | | | |
|---|---|---|---|
| 3,213,635 | 10/1965 | Jacobs | 62/115 |
| 3,412,569 | 11/1968 | Arledge, Jr. | 62/115 |
| 4,006,606 | 2/1977 | Underdue | 62/449 |
| 4,058,384 | 11/1977 | Keefe | 62/457 |
| 4,059,969 | 11/1977 | Awalt, Jr. | 62/238 |
| 4,103,510 | 8/1978 | Hall | 62/299 |
| 4,134,272 | 1/1979 | Reimann | 62/115 |
| 4,195,491 | 4/1980 | Roncaglione | 62/384 |
| 4,593,607 | 6/1986 | Bennett | 92/130 B |
| 4,679,986 | 7/1987 | Dupre | 417/53 |
| 5,115,940 | 5/1992 | Friedman | 220/737 |
| 5,201,183 | 4/1993 | Ramos | 62/4 |
| 5,301,852 | 4/1994 | Mancini | 222/321 |
| 5,363,665 | 11/1994 | Sundman | 62/125 |
| 5,372,017 | 12/1994 | Zorea et al. | 62/457.9 |

FOREIGN PATENT DOCUMENTS

| | | |
|---|---|---|
| 2380076 | 9/1978 | France . |
| 654236 | 3/1979 | U.S.S.R. . |
| 848907 | 7/1981 | U.S.S.R. . |
| 979802 | 12/1982 | U.S.S.R. . |
| 622043 | 4/1949 | United Kingdom . |

*Primary Examiner*—William E. Tapolcai
*Attorney, Agent, or Firm*—Richard C. Litman

[57] ABSTRACT

A manually operated refrigeration apparatus includes a refrigerant compressor which is operated solely by manual or pedal power, and which requires no other automated or external power or energy source. The apparatus generally comprises a cylindrical refrigerant compressor, with the refrigerant being compressed by a piston driven by a coil spring within the cylinder. The spring is in turn compressed by an external lever or pedal operated linkage, with compression of the refrigerant being initiated when the spring compression is released. The refrigerant then passes through an expansion valve, whereby the refrigerant pressure drops to cause the fluid to evaporate and drop in temperature, as in powered refrigeration devices. The apparatus is connected to an insulated cooler chest or the like, with the chest including refrigerant lines within the walls and/or floor. The present refrigeration apparatus is capable of indefinitely maintaining relatively low temperatures within the cooler, thereby preserving food or other articles for relatively long periods of time while away from external power sources. The compression may be pumped up periodically, with the internal spring producing refrigerant flow through the system for a period of time before requiring additional actuation. Once the cooler temperature has reached the desired level, the insulation provides substantial maintenance of the temperature for some period of time before additional operation of the apparatus is required.

20 Claims, 4 Drawing Sheets

MANUAL REFRIGERATION APPARATUS

FIELD OF THE INVENTION

The present invention relates generally to mechanical refrigeration devices providing mechanical compression of a gas and using the temperature drop caused by the expansion of a gas for cooling, and more specifically to a portable device using manually supplied mechanical input for the compression of the gas.

BACKGROUND OF THE INVENTION

Various outdoor activities, such as picnics, overnight camping trips, etc., are enjoyed by many persons. Many such activities, including those mentioned above, involve the preparation of meals, which foods generally must be transported and stored until preparation and consumption. While it is certainly possible to use processed foods which require no refrigeration prior to preparation, consumers have recently become more and more aware of the potential hazards of consuming foods which should be refrigerated.

Accordingly, relatively simple and inexpensive ice chests have become popular for the storage of foods requiring refrigeration, with ice in block, cube, or other form being used as the cooling agent where no electricity is available to power a mechanical unit. Such a cooling system is reasonably effective for a few hours, depending upon the ambient temperature, sunlight, the amount of time the cooler is open, thermal efficiency of the cooler, etc. However, at best, it is unlikely that the use of ice and an ice chest would be capable of preserving food longer than overnight at best, in typical summertime conditions in a temperate climate.

The above limitations would preclude the use of any foods requiring refrigeration for more than an overnight trip, unless more ice were available. This may not be the case, where a three day or longer trip is made into a primitive area, where no facilities are available. Thus, persons wishing to keep perishable foods for more than a day or so, must leave their camping site and seek out a place where they can purchase additional ice in order to keep such foods safely. The only safe alternative is to forgo such perishable foods, and take processed or canned foods which do not require refrigeration. Such foods may be seen as less palatable to many persons, and the exclusive use of such foods for a few days, may well lessen the enjoyment of the camping experience for those persons.

Thus, a need will be seen for a manually operated refrigeration apparatus, which is capable of keeping a container chilled for an indefinitely long period of time with periodic operation. The apparatus should be capable of chilling the interior of an insulated chest to a freezing temperature if desired, and to a temperature between thirty and forty degrees Fahrenheit in order to provide refrigeration of foods which may be contained within the chest. The device must require no external electrical or other power, other than manual (hand or foot operated) input from time to time, in order to compress the refrigerant contained within the device. The apparatus must be readily adaptable to use with a modified ice chest of any suitable configuration, with the ice chest containing cooling coils for the circulation of refrigerant therein, as required. Finally, the device must be economical, portable, easily used, and operable with refrigerants which are environmentally safe.

DESCRIPTION OF THE PRIOR ART

U.S. Pat. No. 3,213,635 issued to James W. Jacobs on Oct. 26, 1965 describes a Refrigerating Apparatus, actually comprising a method of assembling the evaporator tube into the freezing compartment of a refrigerator. The refrigerator is described as using a conventional sealed motor compressor unit; no mention is made of manual operation of the compressor, as provided by the present invention.

U.S. Pat. No. 3,412,569 issued to Arthur E. Arledge, Jr. on Nov. 26, 1968 describes a Refrigeration Apparatus providing for more efficient operation of essentially continuously operating systems during times when the ambient temperature is relatively low. Nevertheless, Arledge, Jr. uses a mechanical compressor in his system, and no manually operated compressor is disclosed.

U.S. Pat. No. 4,006,606 issued to Joyce Underdue on Feb. 8, 1977 describes a Freezing Pot comprising a portable refrigeration unit using an electric motor to drive the compressor. While the device in one embodiment uses batteries to power the compressor motor, it nevertheless relies upon electrical power. No manual means of operating the compressor is disclosed by Underdue.

U.S. Pat. No. 4,058,384 issued to Harry J. Keefe on Nov. 15, 1977 describes a Portable Refrigerator utilizing a hand cranked compressor which withdraws air from within an insulated compartment, compresses the air, cools the heated compressed air in a heat exchanger, and allows the air to expand and cool further as it returns to the insulated container. The principle is essentially the same as that used in the present invention, but Keefe does not take advantage of the greater efficiency provided by the heat release of evaporation of a liquid from a liquid state to a gaseous state, as provided by various liquid refrigerants. Keefe states that the manual crank of his device is capable of removing 50 B.T.U.s of heat per hour from the insulated container, by cranking for only two minutes per hour. However, it is noted that no mention of the total energy input is made (i. e., the total number of revolutions of the crank required). It appears that considerable cranking would be required, considering the inefficiency of the refrigerant used (air) compared to the liquid/gaseous refrigerant used in the present invention.

U.S. Pat. No. 4,059,969 issued to Thomas Y. Awalt, Jr. on Nov. 29, 1977 describes an Air Conditioned Shelter wherein wind power is used to drive the air conditioning compressor. The Awalt, Jr. patent is primarily directed to very large building structures, with wind channeling for greater windmill efficiency provided either by the shapes and placement of the buildings, or by barriers installed in combination with the buildings. The Awalt, Jr. system has nothing in common with the current manually operated portable refrigeration apparatus, other than avoiding need for electrical or chemical energy for operation.

U.S. Pat. No. 4,103,510 issued to Roger W. Hall on Aug. 1, 1978 describes a Portable Cooling Chest Operatively Attachable To An Automobile Air Conditioning System. The chest is placed in the trunk of the car, and connected to the conventional air conditioning refrigerant system of the car by quick disconnect couplers. While the cooling chest itself is portable, it cannot be chilled when it is removed from the car for portability, as it relies upon the mechanically powered air conditioning system of the car for operation. Also, the present system is permanently installed with a cooler chest, thus avoiding loss of refrigerant.

U.S. Pat. No. 4,134,272 issued to Robert C. Reimann on Jan. 16, 1979 describes a Protection Circuit For A Dual Source Refrigeration Unit. The system is powered by a "prime mover" or chemical combustion engine or the like, which in turn powers a motor-generator which drives the compressor of the system. No manual compression or portability of the system is disclosed.

U.S. Pat. No. 4,195,491 issued to Walter Roncaglione on Apr. 1, 1980 describes a Dry Ice Refrigerator wherein a relatively smaller sealed container of solid carbon dioxide ("dry ice") is removably installed within an insulated cooler chest. Cooling coils are also installed within the chest, and are connected to the dry ice container. As the dry ice sublimates, or changes from solid to gaseous state, the gas flows through the tubes and exits the chest through an adjustable valve. The refrigeration is due entirely to the dry ice contained within the container; no manually operated mechanical compression apparatus is disclosed. Once the dry ice has completely evaporated, no further cooling of the contents of the chest is possible.

U.S. Pat. No. 4,593,607 issued to Robert A. Bennett on Jun. 10, 1986 describes a Spring-Piston Combination For Manually Operated Pump. The C-shaped spring acts on the trigger, rather than on the piston in the pump cylinder, whereas the present invention utilizes a spring acting directly on the piston of the pump. The Bennett device is adapted to a hand trigger type spray pump and nozzle. While the present invention makes use of the manual compression of a spring which in turn is used to compress the refrigerant fluid, the structure, function, scale, and purpose of the present invention are totally different from those features of the present invention.

U.S. Pat. No. 4,679,986 issued to U.S. Pat. No. 4,679,986 issued to Milburn E. Dupre on Jul. 14, 1987 describes an Energy Conserving Refrigeration Apparatus And Method wherein a dual piston system is used. One piston is free, and is alternatively exposed to pressure and vacuum by the action of a linkage driven by another piston (or set of pistons). The system is powered by a motor, and no mention of manual operation or portability is made by Dupre.

U.S. Pat. No. 5,115,940 issued to Todd A. Friedman on May 26, 1992 describes a Container Cooler Apparatus comprising an insulated can holder with a handle having a pressurized carbon dioxide cylinder or can therein. The cylinder or can is punctured or opened, and the drop in pressure of the gas as it is released to flow around a beverage can or the like inserted within the holder, causes a drop in temperature which is transferred to the beverage can. While no chemical or electrical power is required by the Friedman device, there is also no provision for manual operation or any means to repeat the cycle, once the gas has been depleted. The refrigerant of the present manually operated portable system remains within a closed system and is recyclable indefinitely.

U.S. Pat. No. 5,201,183 issued to John F. Ramos on Apr. 13, 1993 describes a Cooling Device For Beverage Cans, wherein the heat exchanger is installed within the beverage can. A deformable pocket is provided on the bottom of the can, with the pocket containing a liquified gas (e.g., air or nitrogen). When the pocket is deformed, the pocket is burst, causing the gas to flow through the heat exchanger within the can. Aside from the expense of providing such a system within an individual disposable can and the difficulty in handling the liquified gas, the system is not recyclable and does not use manual power to compress a refrigerant.

U.S. Pat. No. 5,301,852 issued to Carlo Mancini on Apr. 12, 1994 describes a Manually Operated Pump For Dispensing Liquid Or Creamy Substances At A Predetermined Constant Pressure. The device is adapted to be placed upon a liquid container of some sort (e.g., liquid soap, etc.). While it is a manually operated pump, it has nothing whatsoever to do with refrigeration systems, and no recyclable fluid, refrigerant or otherwise, is disclosed.

U.S. Pat. No. 5,363,665 issued to Kurt Sundman on Nov. 15, 1994 describes a Hand Pump For Evacuating And Charging A Refrigerating System. The pump valving is adapted to provide only a relative vacuum within the system, rather than to pressurize the system via a spring, as accomplished by the present invention. The pump evacuates refrigerant from the system to allow opening and maintenance of the system, and further evacuates the system to remove air and moisture prior to recharging. The device does not further pressurize the system; thus, no cooling or refrigeration action is provided by the Sundman pump, as is provided by the present invention with its closed and recyclable refrigerant system.

U.S. Pat. No. 5,372,017 issued to Hugo Zorea et al. on Dec. 13, 1994 describes a Fluid Cooling System for a single beverage can, comprising a generally helical coil which surrounds the can. The coil is connected to the refrigerant lines of an automobile air conditioning system, and is chilled by the refrigerant passing through the coil. Thus, the device is more closely related to the Hall cooler discussed above, which is connected to an automobile air conditioning system, than to the present invention. Zorea et al. make no disclosure of any manual means of operation for their beverage cooling system.

British Patent Publication No. 622,043 to Lightfoot Refrigeration Co., Ltd. and accepted on Apr. 26, 1949 describes Improvements In Or Relating To Compression Refrigeration Systems. The publication describes a method of separating the lubricating oil normally mixed with the refrigerant, which oil serves to lubricate the compressor, in order to provide a reduced level of oil in the refrigerant as it passes through the evaporator, for better heat transfer. No disclosure is made of the use of any portable system, nor of any manual operation of the system.

French Patent Publication No. 2,380,076 to Norbert Normos and published on Sep. 8, 1978 describes a liquid atomizer and hand pump mechanism, adapted for the spraying of small quantities of liquids (water, perfumes, deodorant, etc.). No recirculation of any fluid contained therein is disclosed, nor is any means provided for cooling any other article. The plunger is returned by means of a coiled spring, as is generally used in the present invention, but no other commonality is seen.

Soviet Patent Publication No. 654,236 published on Mar. 30, 1979 describes an atomizer, including a secondary container therewith. The device apparently utilizes a resilient bulb an appropriate valving for operation. The device bears no other relationship to the present manually operated portable refrigeration apparatus.

Soviet Patent Publication No. 848,907 published on Jul. 23, 1981 describes a refrigeration system having an expansion valve with variable inlet geometry. The valve further includes a turbine wheel, which is turned by the expanding refrigerant to extract further heat energy from the refrigerant, as well as useful work. No portability or manual operation of the system is apparent.

Finally, Soviet Patent No. 979,802 published on Dec. 17, 1982 describes a refrigeration unit wherein the drive motor comprises dual coaxial rotors (one driving the compressor and one turning a fan for the evaporator) sharing a common stator. While the arrangement is relatively compact, portability is not apparent, and no alternative manual operation is possible due to the integral arrangement of the electric motor compressor and fan drive.

None of the above noted patents, taken either singly or in combination, are seen to disclose the specific arrangement of concepts disclosed by the present invention.

SUMMARY OF THE INVENTION

By the present invention, an improved manual refrigeration apparatus is disclosed.

Accordingly, one of the objects of the present invention is to provide an improved manual refrigeration apparatus which requires no automated external power source, chemical combustion engine, or electric motor for the provision of compressor power, but which is operated solely by manual or pedal actuation of a mechanism adapted to energize the system to provide fluid flow therethrough.

Another of the objects of the present invention is to provide an improved manual refrigeration apparatus which includes a refrigerant fluid therein, which refrigerant fluid flow through the system is energized manually.

Yet another of the objects of the present invention is to provide an improved manual refrigeration apparatus which comprises a cylinder having a coil spring therein, with the manual operation comprising compression of the spring, which in turn provides compression of the refrigerant upon spring compression release.

Still another of the objects of the present invention is to provide an improved manual refrigeration apparatus which is portable and adapted for carriage by hand as desired.

A further object of the present invention is to provide an improved manual refrigeration apparatus which is adapted for the permanent installation to an insulated cooler, with the cooler including refrigerant lines disposed through the walls and/or floor thereof.

An additional object of the present invention is to provide an improved manual refrigeration apparatus and insulated cooler having refrigerant lines disposed therein, in combination.

Another object of the present invention is to provide an improved manual refrigeration apparatus which refrigerant is selected from the group consisting of environmentally safe refrigerants.

Yet another object of the present invention is to provide an improved manual refrigeration apparatus which interior and coolant lines are permanently sealed to preclude more than minuscule loss of refrigerant to the environment, thereby obviating need for frequent recharging of the system.

A final object of the present invention is to provide an improved manual refrigeration apparatus for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
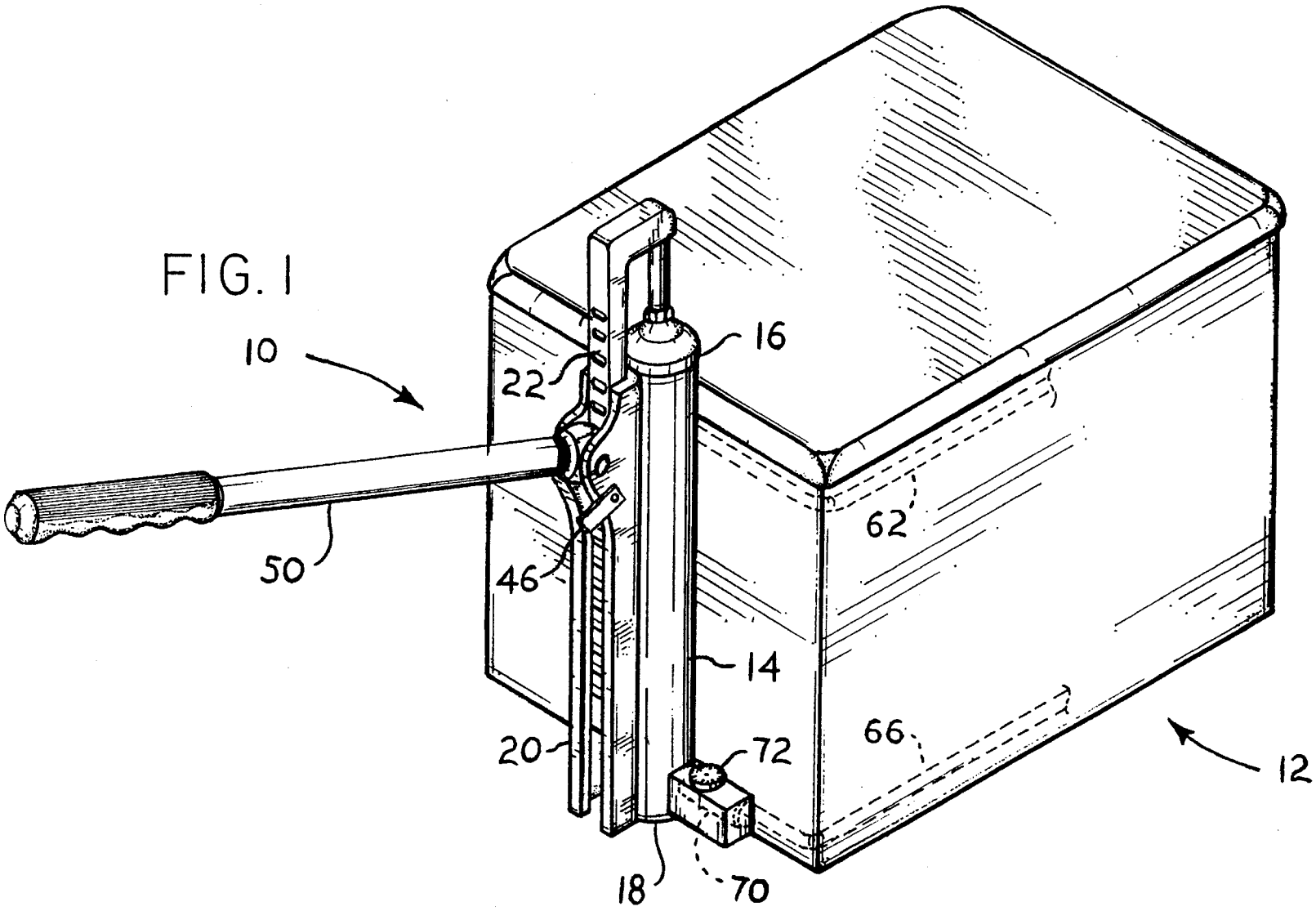
FIG. 1 is a perspective view of the present manual refrigeration apparatus, attached to an insulated cooler chest and incorporating refrigerant lines within the chest structure and other features.

Referring now particularly to FIG. 1 of the drawings, the present invention will be seen to relate to a manually operated refrigeration apparatus 10, which provides cooling or refrigeration of a relatively small volume such as a cooler chest 12 or the like. (It will be understood that the term "manual" as used throughout the present specification and claims in describing the operation of the present invention, should be interpreted sufficiently broadly so as to include not only operation by means of a hand lever, but also by means of a foot actuated pedal, in the same sense that an automobile "manual transmission" also includes use of a foot operated clutch pedal. The present apparatus 10 is powered solely by physical input from an operator, and does not use any mechanical power source, such as an electric or gasoline motor, etc.)

The refrigeration apparatus 10 generally comprises a cylinder 14 having a first or refrigerant return end 16 and an opposite second or refrigerant discharge end 18, which cylinder 14 serves as the compressor portion of the apparatus. The cylinder 14 includes a channel 20 affixed to the exterior thereof, and parallel to the axis of the cylinder 14. The channel 20 includes a ratchet rod 22 therein, with the ratchet rod 22 being captured within the walls of the channel 20 but being free to move parallel to the cylinder 14 in a direction either toward the first end 16 or toward the opposite second end 18 of the cylinder 14, with limitations as will be discussed further below.

Figure 2:
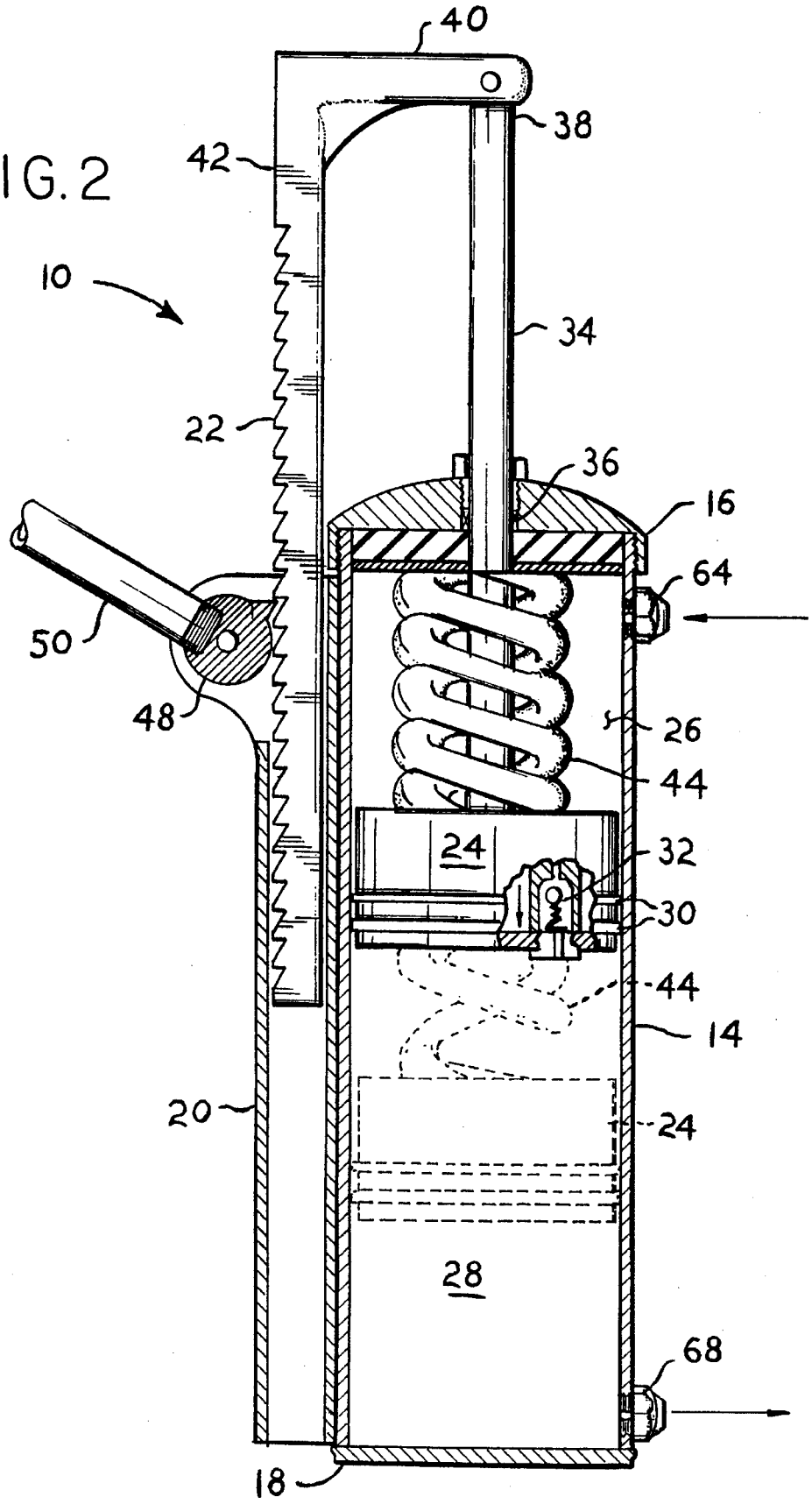
FIG. 2 is a side view in section of the present manual refrigeration apparatus, showing the details of its structure and operation.

FIG. 2 provides a side elevation view in section of the present manual refrigeration apparatus 10, and serves to clarify the structure and operation of the device. The cylinder 14 contains a piston 24 therein, which is movable between the two ends 16 and 18 of the cylinder 14 and which effectively seals a first volume 26 and a second volume 28 (respectively adjacent the first and second ends 16 and 18 within the cylinder 14) and which varies the two volumes 26/28 inversely with respect to one another as the piston 24 is moved within the cylinder. (It will be understood that the clearances shown between the piston 24 and the cylinder 14 interior are exaggerated for clarity, and that the piston 24 may include one or more compression or sealing rings 30 thereon, to provide a better seal.) The piston 24 also includes a one way check valve 32 (a ball check as shown, or alternatively a poppet, flapper, or other suitable valve) which allows flow of refrigerant from the first volume 26, through the piston 24, and into the second volume 28, but which prevents flow in the opposite direction from the second volume 28 to the first volume 26.

The piston 24 is connected to a rod 34, which passes through the first volume 26 and out of the first end 16 of the cylinder 14. The first end 16 of the cylinder 14 includes a seal 36 disposed about the rod 34, to preclude leakage of refrigerant from the first end 16 of the cylinder 14. (Preferably, the first end 16 comprises a removable cap to provide for maintenance of components within the cylinder 14 as might be required, while the opposite second end 18 may be welded or otherwise permanently affixed in place.) The first or outer end 38 of the rod 34 is attached to a link 40, which is in turn affixed to the first end 42 of the ratchet rod 22. Thus, as the ratchet rod 22 is pushed upwardly in the direction the first end 16 of the cylinder 14, the link 40 between the ratchet rod 22 and the piston rod 34, causes the piston rod 34 also to be drawn out of the first end 16 of the cylinder 14.

Normally, the piston 24 is urged toward the second end 18 of the cylinder 14 by means of a compression spring 44 (preferably a coil spring disposed about the piston rod 34 and between the piston 24 and first end 16 of the cylinder). It will be seen that as the ratchet rod 22 is connected to the piston 24 by the piston rod 34 and link 40, that the ratchet rod 22 is also urged in the direction of the second end 18 of the cylinder 14 by the spring 44. However, a selectively releasable ratchet detent 46 (FIGS. 1 and 4) serves to hold the ratchet rod 22 at each increment or notch as the rod 22 is incrementally advanced in the direction of the first cylinder end 16 to move the piston 24 toward the first cylinder end 16, and to compress the spring 44. The ratchet rod 22 is advanced by a pivotable pawl 48 or other suitable device, which in turn is actuated by an elongate handle 50 providing the required mechanical advantage. The handle 50 may be removable for storage, if desired.

The above described ratchet mechanism will be seen to have some similarities to an automobile bumper jack, with a pivotable handle and pawl assembly providing the required mechanical advantage to lift many times the force applied to the handle. In a model of the present invention, the compression spring 44 provides a compressive force on the order of 42 pounds per inch, and has a travel of some thirteen inches within the cylinder. Thus, the total force required to compress the spring 44 at its maximum compression, is just over 540 pounds. The mechanical advantage provided by the length of the handle 50, and the relatively short arm of the pawl 48 or other mechanism, provides a mechanical advantage on the order of 30 to 1, or a force at the end of the handle 50 of only about eighteen pounds. Thus, virtually any user of the present apparatus 10 is capable of applying the required force to compress the spring 44 fully, for optimum effect.

Figure 4:
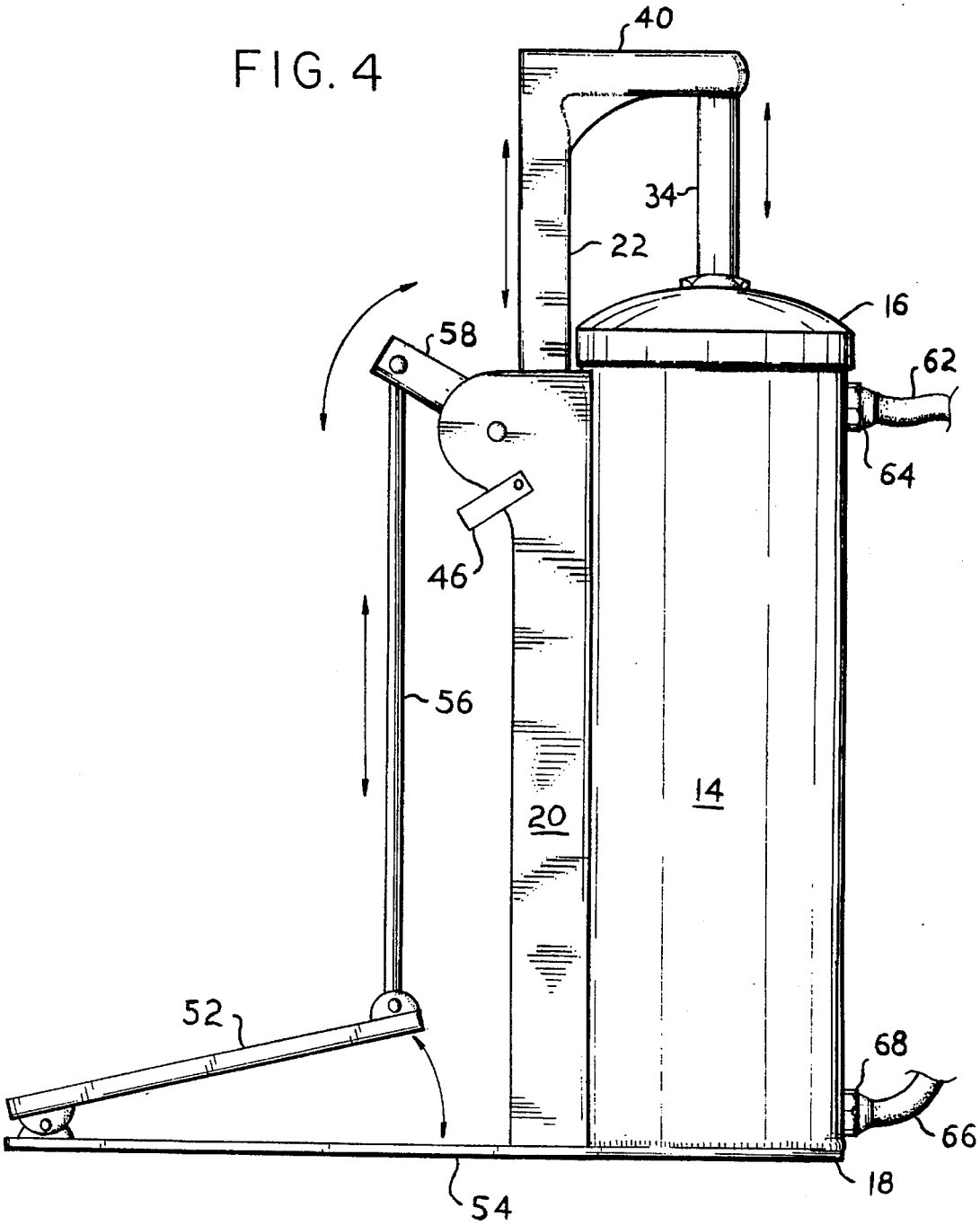
FIG. 4 is a side elevation view of the present apparatus, showing an alternative actuation means therefor.

FIG. 4 provides a side elevation view of an alternative embodiment, wherein a foot actuated pedal 52 is used to provide the compressive force for the spring. A base plate 54 extends from the cylinder 14, with the pedal 52 being hingedly or pivotally attached to the base plate 54 at its distal end the opposite end of the pedal 52 has a pull rod linkage 56 extending therefrom, connecting to a pivotally mounted ratchet lever 58, which lever 58 may be considered as the equivalent of a very short version of the elongate handle of FIGS. 1 and 2 and the accompanying ratchet rod actuating pawl 48. Thus, a person may use their weight to provide the required mechanical force to pivotally cycle the lever 58, thus incrementally advancing the ratchet rod 22 in the direction of the first end 16 of the cylinder 14. The remaining components of the apparatus are substantially similar to those discussed above.

It will be seen that other means may be used to provide the required mechanical linkage to advance the ratchet rod 22 along the channel 20. For example, a gear may be substituted for the pawl 48, and some form of releasable ratchet (as in a ratcheting wrench handle) may be provided to hold the gear in position as the wrench handle is backed off after each incremental advance for another stroke. Releasing the ratchet latch would free the ratchet rod and its attached link to the piston rod, thereby freeing the compression spring to advance the piston toward the second end of the cylinder. The above described mechanism will also be seen to be similar to ratchet mechanisms in "come-along" type mechanisms, used for drags, hoists, etc.

Figure 3:
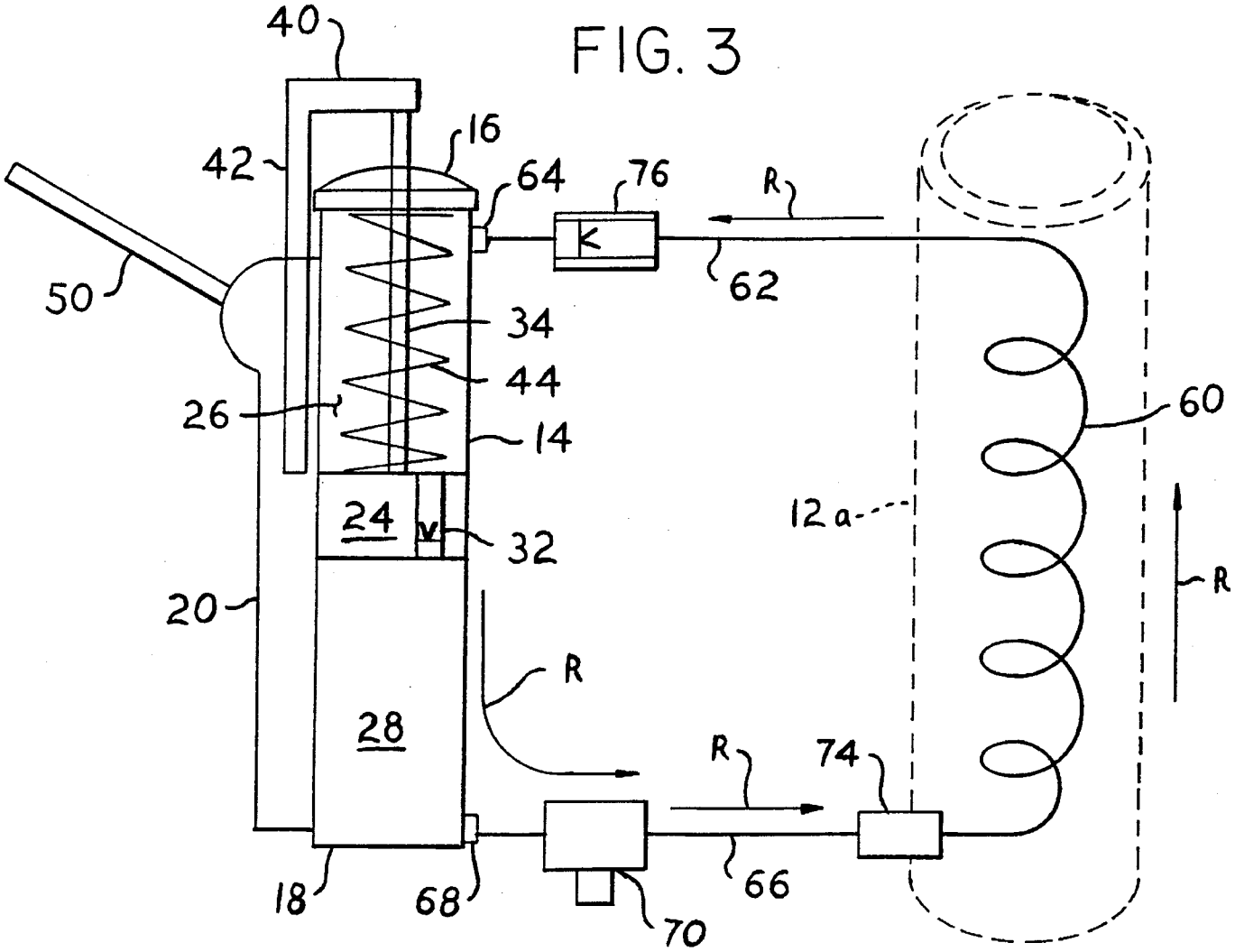
FIG. 3 is a mechanical schematic drawing of the operation of the present manual refrigeration apparatus.

The above described apparatus provides a sealed unit, with the only moving part entering the cylinder 14 being the piston rod 34, which passes through a seal 36 in the first end 16 of the cylinder 14. The cylinder 14 is in turn connected to a refrigerant line 60, comprising an elongate hollow tube which forms a closed loop within the walls and/or floor of the cooler 12 to provide refrigerant circulation therethrough. The refrigerant return portion 62 of the line 60 is connected to the cylinder 14 at a return port 64 adjacent the first end 16 of the cylinder 14, while the refrigerant discharge portion 66 of the line 60 is connected to a discharge port 68 adjacent the second end of the cylinder 14. The return and discharge portions 62 and 66 of the refrigerant line 60, and the attachment of the apparatus 10 to a cooler chest 12, are shown in FIG. 1, while FIG. 3 provides a schematic view of the entire system and additional components required or desired for proper operation and will be referred to below in a discussion of the operation of the apparatus and system.

Initially, the cylinder 14 (and the attached refrigerant line 60) are supplied with an appropriate compressible refrigerant, by compressing the spring 44 and advancing the piston 24 toward the first end 16 of the cylinder 14 to provide adequate volume within the second volume 28. A refrigerant charging or recharging valve 70 (which may comprise a receiver-drier, providing for the removal of moisture from the refrigerant) may be provided for this purpose in the refrigerant line discharge portion 66, near or immediately adjacent to the discharge port 68 of the cylinder 14. An adequate quantity of refrigerant may be determined by means of a pressure gauge 72 (shown in FIG. 1), communicating with the second volume 28 of the cylinder 14, either directly or by means of the discharge line 66. A sight gauge (not shown) may also be provided to assist in determining the quantity of the refrigerant contained within the apparatus.

Preferably, the refrigerant used in the present apparatus is an environmentally safe substance, which has no tendencies to break down chemically under ultraviolet light, or otherwise cause potential environmental damage. The volumes and pressures used in the model of the present apparatus have been based upon the use of Suva (tm), manufactured by the DuPont Corporation. It will be understood that other refrigerants may be used, whether based upon chlorofluorocarbon chemistry or even upon older substances (e.g., ammonia has been used in early refrigeration systems). However, the volumes and pressures required for different refrigerants may vary, as may seal compatibility and other factors. It will be seen that the present apparatus may be adapted to use virtually any type of refrigerant desired, by modifying the above variables as required while still retaining the same basic operating principle.

Once the apparatus is charged with refrigerant, it is ready for use. The ratchet latch or detent 46 (FIGS. 1 and 4) may be released, and the spring 44 will force the piston 24 toward the second or refrigerant discharge end 18 of the cylinder 14. (The refrigerant is precluded from flow directly from the second volume 28, through the piston 24 to the first volume 26, by means of the check valve 32 within the piston 24.) The pressurized refrigerant will flow out of the cylinder 14 and through the discharge portion 66 of the refrigerant line 60, to the expansion valve 74, which restricts the flow of refrigerant to cause a pressure drop and evaporation and accompanying temperature drop of the refrigerant on the downstream side of the valve 74, in the refrigerant line coil 60.

The cold refrigerant in vapor form then circulates through the refrigerant coil 60, which may be enclosed within a cooler 12*a*. (While the cooler 12*a* of FIG. 4 is shown with a cylindrical configuration, it will be seen that a cooler attached to the present apparatus 10 and in combination therewith, may have virtually any shape or configuration and should not be limited only to the rectangular and cylindrical configurations shown.) The refrigerant then returns to the first volume 26 of the cylinder 14 through the refrigerant return portion 62 of the refrigerant line 60, and through a one way check valve 76 which precludes refrigerant flow directly from the first volume 26 into the return portion 62 of the refrigerant line 60. This refrigerant flow path is indicated by the refrigerant flow arrows R in FIG. 3. (It will be understood that the cooler 12*a* may be immediately adjacent the cylinder 14. The components are shown widely separated in FIG. 3, to provide clarity in the disclosure.)

When substantially all of the refrigerant has left the second volume 28 of the cylinder 14 and the spring 44 has expanded to its maximum length, thereby forcing the piston downward to decrease the second volume 28 as the refrigerant is forced therefrom through the expansion valve 74, the ratchet mechanism may be used to compress the spring 44 to begin another cycle. The pressure gauge 72 may be glanced at occasionally during the refrigeration cycle, to determine the remaining pressure within the second volume 28. (The relative height or position of the ratchet rod 42 and attached piston rod 34 also provide a good indication of the operation of the cycle.)

The above operation may be repeated as required, to provide cooling within the accompanying cooler 12/12*a* as desired. The mechanical advantage provided by the operating mechanism will require on the order of thirty strokes of the handle 50 or pedal 52 with the model upon which the present disclosure is based. Thus, on the order of thirty seconds or so would likely be required to compress the spring 44 for a single cycle. As the cycle requires some period of time for essentially all of the refrigerant to flow through the expansion valve 74, continuous pumping of the handle or pedal is not required; such action is only required every few minutes or so during the initial cooling phase. Once the interior of the cooler 12/12*a* has reached the desired level (a thermometer, not shown, may be provided) the temperature will remain at or near the desired level for a few hours or so, depending upon the value of the cooler insulation, the ambient temperature, shade, etc. In any case, essentially continuous operation of the spring compression mechanism is not at all necessary, once the desired cooler temperature has been reached.

In summary, the above described portable, manually operated refrigeration apparatus 10, and any accompanying cooler 12/12*a* etc., will be seen to provide an excellent means of keeping perishable foods or other articles cold for long periods of time while away from sources of power required for conventional refrigeration systems. While the ability to take along perishable foods for back country trips of several days may be seen as a convenience to many, the present invention also opens up the possibility of such trips for many who were prohibited from such travel heretofore, due to a requirement for medical supplies which required refrigeration, or other reason. The ability to keep photographic film fresh by means of the present refrigeration apparatus is also desirable to many photographers, and in fact may be the only means available for news professionals in disaster areas or other locations where power is not available.

It will also be seen that the present invention is not limited to use with an insulated cooler, although such combination is seen as a primary use. The present apparatus may also be used to cool other volumes or articles, up to and including very small rooms or the interior of a small automobile. Such cooling will only result in a relatively few degrees difference between the ambient temperature and the interior volume being cooled, but such a temperature difference is sufficient to provide relatively great comfort, particularly when the cooler air is dehumidified to a certain extent by the cooling action of the present apparatus, in humid conditions. Thus, the present apparatus will be seen to provide an extremely versatile, practical, and economical means of cooling a volume for innumerable purposes, limited only by the imagination and desires of the user.

It is to be understood that the present invention is not limited to the sole embodiments described above, but encompasses any and all embodiments within the scope of the following claims.

I claim:

1. A portable manually operated refrigeration apparatus, comprising:

a sealed compressor cylinder having a first end and an opposite second end and including a piston therein, with said piston separating said cylinder into a variable first volume adjacent said first end and a variable second volume adjacent said second end and traveling between said first end and said second end of said cylinder and having a piston rod extending therefrom and exiting said first end of said cylinder through a seal disposed around said rod;

said cylinder further including a compression spring disposed therein, said compression spring urging said piston toward said second end of said cylinder;

at least one refrigerant line comprising a closed loop having a refrigerant return portion connected to said cylinder adjacent said first end and a refrigerant discharge portion connected to said cylinder adjacent said second end, and a compressible refrigerant disposed within said cylinder and said refrigerant line, and;

external spring compression means connected to said rod and providing for the actuation of said piston within said cylinder to compress said spring, said external means being operable solely by physical power provided by a person using said manually operated refrigeration apparatus, whereby;

said external means is operated to draw said rod from said cylinder and thereby move said piston toward said first end of said cylinder to compress said spring thereby, and said external means is then released to allow said spring to move said piston toward said second end of said cylinder, thereby compressing said refrigerant within said second volume and forcing said refrigerant to circulate through said closed loop refrigerant line and back to said cylinder, to provide cooling within said refrigerant line.

2. The manually operated refrigeration apparatus of claim 1, wherein:

said external spring compression means comprises an elongate external handle pivotally connected to said cylinder and a ratchet rod movably disposed along said cylinder and parallel to said piston rod, with said external handle providing for the incremental movement of said ratchet rod along said cylinder in the direction of said first end of said cylinder, and said ratchet rod having a first end affixed to said piston rod by means of a fixed link therebetween, and;

said cylinder further includes a selectively releasable detent disposed thereon and communicating with said ratchet rod to hold said ratchet rod against said piston rod, said piston, and said compression spring as said handle is pivotally actuated to urge said ratchet rod incrementally along said cylinder in the direction of said first end, thereby to draw said piston rod from said cylinder and to compress said spring within said first volume by means of drawing said piston toward said first end of said cylinder, with said detent being released to release said ratchet rod to travel in the direction of said second end of said cylinder and thereby to allow said spring to expand to push said piston toward said second end of said cylinder thereby to compress said refrigerant within said second volume of said cylinder.

3. The manually operated refrigeration apparatus of claim 1, wherein:

said external spring compression means comprises an external ratchet lever connected to said cylinder and a ratchet rod movably disposed along said cylinder and parallel to said piston rod, with said ratchet lever providing for the incremental movement of said ratchet rod along said cylinder in the direction of said first end of said cylinder, and said ratchet rod having a first end affixed to said piston rod by means of a fixed link therebetween;

said cylinder further having a pedal hingedly connected thereto, and a linkage extending between said pedal and said ratchet lever, with operation of said pedal causing said ratchet lever to move said ratchet rod incrementally along said cylinder in the direction of said first end of said cylinder, and;

said cylinder further includes a selectively releasable detent disposed thereon and communicating with said ratchet rod to hold said ratchet rod against said piston rod, said piston, and said compression spring as said ratchet lever is pivotally actuated to urge said ratchet rod incrementally along said cylinder in the direction of said first end, thereby to draw said piston rod from said cylinder and to compress said spring within said first volume by means of drawing said piston toward said first end of said cylinder, with said detent being released to release said ratchet rod to travel in the direction of said second end of said cylinder and thereby to allow said spring to expand to push said piston toward said second end of said cylinder thereby to compress said refrigerant within said second volume of said cylinder.

4. The manually operated refrigeration apparatus of claim 1, wherein:

said compression spring comprises a coil spring disposed around said piston rod and compressively positioned within said first volume between said piston and said first end of said cylinder.

5. The manually operated refrigeration apparatus of claim 1, wherein:

said piston includes at least one sealing ring circumferentially disposed therearound, with said piston and said at least one sealing ring serving to sealingly separate said first volume from said second volume within said cylinder.

6. The manually operated refrigeration apparatus of claim 1, including:

a refrigerant expansion valve installed in said refrigerant discharge portion of said refrigerant line.

7. The manually operated refrigeration apparatus of claim 1, wherein:

said piston includes a check valve installed therein, with said check valve allowing refrigerant flow only from said first volume to said second volume and precluding refrigerant flow from said second volume to said first volume within said cylinder.

8. The manually operated refrigeration apparatus of claim 1, wherein:

said refrigeration apparatus includes a refrigerant return check valve installed in said refrigerant return portion of said refrigerant line and adjacent to said second end of said cylinder, with said refrigerant return check valve allowing refrigerant flow from said refrigerant line into said first volume of said cylinder and precluding refrigerant flow from said first volume of said cylinder into said refrigerant line.

9. The manually operated refrigeration apparatus of claim 1, including:

a refrigerant recharging valve installed between said second volume of said cylinder and said refrigerant discharge portion of said refrigerant line.

10. The manually operated refrigeration apparatus of claim 1, including:

a refrigerant pressure gauge installed on said apparatus and communicating with said second volume to provide indication of the refrigerant pressure therein.

11. The manually operated refrigeration apparatus of claim 1, including:

an insulated cooler, with said at least one refrigerant line of said apparatus being installed within said cooler.

12. A manually operated refrigeration apparatus, comprising:

a compressor cylinder having a first end and an opposite second end and including a piston therein, with said piston separating said cylinder into a variable first volume adjacent said first end and a variable second volume adjacent said second end and traveling between said first end and said second end of said cylinder and having a piston rod extending therefrom and exiting said first end of said cylinder through a seal disposed around said rod;

said cylinder further including a compression spring disposed therein, said compression spring urging said piston toward said second end of said cylinder;

at least one refrigerant line comprising a closed loop having a refrigerant return portion connected to said cylinder adjacent said first end and a refrigerant discharge portion connected to said cylinder adjacent said second end, and a compressible refrigerant disposed within said cylinder and said refrigerant line;

an insulated cooler connected to said cylinder, with said cooler including walls and a floor and having said at least one refrigerant line installed therein, and;

external spring compression means connected to said rod and providing for the actuation of said piston within said cylinder to compress said spring, said external means being operable solely by physical power provided by a person using said manually operated refrigeration apparatus, whereby;

said external means is operated to draw said rod from said cylinder and thereby move said piston toward said first end of said cylinder to compress said spring thereby, and said external means is then released to allow said spring to move said piston toward said second end of said cylinder, thereby compressing said refrigerant within said second volume and forcing said refrigerant to circulate through said closed loop refrigerant line within said cooler and back to said cylinder, to provide cooling within said refrigerant line and said cooler.

13. The manually operated refrigeration apparatus of claim 12, wherein:

said external spring compression means comprises an elongate external handle pivotally connected to said cylinder and a ratchet rod movably disposed along said cylinder and parallel to said piston rod, with said external handle providing for the incremental movement of said ratchet rod along said cylinder in the direction of said first end of said cylinder, and said ratchet rod having a first end affixed to said piston rod by means of a fixed link therebetween, and;

said cylinder further includes a selectively releasable detent disposed thereon and communicating with said ratchet rod to hold said ratchet rod against said piston rod, said piston, and said compression spring as said handle is pivotally actuated to urge said ratchet rod incrementally along said cylinder in the direction of said first end, thereby to draw said piston rod from said cylinder and to compress said spring within said first volume by means of drawing said piston toward said first end of said cylinder, with said detent being released to release said ratchet rod to travel in the direction of said second end of said cylinder and thereby to allow said spring to expand to push said piston toward said second end of said cylinder thereby to compress said refrigerant within said second volume of said cylinder.

14. The manually operated refrigeration apparatus of claim 12, wherein:

said external spring compression means comprises an external ratchet lever connected to said cylinder and a ratchet rod movably disposed along said cylinder and parallel to said piston rod, with said ratchet lever providing for the incremental movement of said ratchet rod along said cylinder in the direction of said first end of said cylinder, and said ratchet rod having a first end affixed to said piston rod by means of a fixed link therebetween;

said cylinder further having a pedal hingedly connected thereto, and a linkage extending between said pedal and said ratchet lever, with operation of said pedal causing said ratchet lever to move said ratchet rod incrementally along said cylinder in the direction of said first end of said cylinder, and;

said cylinder further includes a selectively releasable detent disposed thereon and communicating with said ratchet rod to hold said ratchet rod against said piston rod, said piston, and said compression spring as said ratchet lever is pivotally actuated to urge said ratchet rod incrementally along said cylinder in the direction of said first end, thereby to draw said piston rod from said cylinder and to compress said spring within said first volume by means of drawing said piston toward said first end of said cylinder, with said detent being released to release said ratchet rod to travel in the direction of said second end of said cylinder and thereby to allow said spring to expand to push said piston toward said second end of said cylinder thereby to compress said refrigerant within said second volume of said cylinder.

15. The manually operated refrigeration apparatus of claim 12, wherein:

said compression spring comprises a coil spring disposed around said piston rod and compressively positioned within said first volume between said piston and said first end of said cylinder.

16. The manually operated refrigeration apparatus of claim 12, wherein:

said piston includes at least one sealing ring circumferentially disposed therearound, with said piston and said at least one sealing ring serving to sealingly separate said first volume from said second volume within said cylinder.

17. The manually operated refrigeration apparatus of claim 12, including:

a refrigerant expansion valve installed in said refrigerant discharge portion of said refrigerant line.

18. The manually operated refrigeration apparatus of claim 12, wherein:

said piston includes a check valve installed therein, with said check valve allowing refrigerant flow only from said first volume to said second volume and precluding refrigerant flow from said second volume to said first volume within said cylinder.

19. The manually operated refrigeration apparatus of claim 12, wherein:

said refrigeration apparatus includes a refrigerant return check valve installed in said refrigerant return portion of said refrigerant line and adjacent to said second end of said cylinder, with said refrigerant return check valve allowing refrigerant flow from said refrigerant line into said first volume of said cylinder and precluding refrigerant flow from said first volume of said cylinder into said refrigerant line.

20. The manually operated refrigeration apparatus of claim 12, including:

a refrigerant recharging valve installed between said second volume of said cylinder and said refrigerant discharge portion of said refrigerant line, and;

a refrigerant pressure gauge installed on said apparatus and communicating with said second volume to provide indication of the refrigerant pressure therein.

* * * * *